US008555924B2

(12) United States Patent
Faram et al.

(10) Patent No.: US 8,555,924 B2
(45) Date of Patent: Oct. 15, 2013

(54) VORTEX FLOW CONTROL DEVICE

(75) Inventors: Michael G. Faram, Bristol (GB); Robert Yaw Gyamfi Andoh, South Portland, ME (US); Jeremy P. Lecornu, Somerset (GB); Keith G. Hutchings, Weston-super-Mare (GB); Daniel S. Jarman, Somerset (GB)

(73) Assignee: Hydro International plc, Clevedon (GB)

( * ) Notice: Subject to any disclaimer, the term of this patent is extended or adjusted under 35 U.S.C. 154(b) by 240 days.

(21) Appl. No.: 12/670,628

(22) PCT Filed: Jul. 25, 2008

(86) PCT No.: PCT/GB2008/002548

§ 371 (c)(1),
(2), (4) Date: Apr. 28, 2010

(87) PCT Pub. No.: WO2009/013509

PCT Pub. Date: Jan. 29, 2009

(65) Prior Publication Data

US 2010/0300568 A1 Dec. 2, 2010

(30) Foreign Application Priority Data

Jul. 26, 2007 (GB) ..... 0714594.9

(51) Int. Cl.
*F15C 1/16* (2006.01)

(52) U.S. Cl.
USPC ..... 137/812

(58) Field of Classification Search
USPC ..... 137/808, 810, 812, 813; 251/126
See application file for complete search history.

(56) References Cited

U.S. PATENT DOCUMENTS

| | | | | | |
|---|---|---|---|---|---|
| 3,474,670 | A | * | 10/1969 | Rupert | 73/861.32 |
| 3,513,865 | A | * | 5/1970 | Van Der Heyden | 137/813 |
| 3,516,551 | A | * | 6/1970 | Neumann et al. | 210/512.1 |
| 3,521,657 | A | * | 7/1970 | Ayers | 137/813 |
| 4,159,073 | A | * | 6/1979 | Liller | 228/125 |
| 4,206,783 | A | | 6/1980 | Brombach | |
| 5,080,137 | A | * | 1/1992 | Adams | 137/810 |

(Continued)

FOREIGN PATENT DOCUMENTS

| | | |
|---|---|---|
| DE | 3435477 A1 | 3/1986 |
| FR | 2365713 A1 | 4/1978 |

(Continued)

OTHER PUBLICATIONS

U.K. Search Report for Application GB0714594.9 dated Oct. 23, 2007.

(Continued)

*Primary Examiner* — Eric Keasel
*Assistant Examiner* — Kevin Barss
(74) *Attorney, Agent, or Firm* — Honigman Miller Schwartz and Cohn LLP

(57) ABSTRACT

A vortex flow control device is manufactured by forming a template unit having end walls of which the wall has an outlet opening, and a partial outer wall. The partial outer wall has an opening. A plate is subsequently secured to the template unit to partially close the opening, to leave an inlet. The size of the plate is selected so as to result in an inlet 30 sized to achieve required flow characteristics for the finished device. The plate his inclined to a planar portion on the opposite side of the inlet at an angle in the range 85° to 95°, so as to induce turbulence in the region of the inlet.

8 Claims, 5 Drawing Sheets

(56) References Cited

U.S. PATENT DOCUMENTS

| | | | | |
|---|---|---|---|---|
| 5,303,782 | A * | 4/1994 | Johannessen | 137/809 |
| 5,524,393 | A * | 6/1996 | Nill et al. | 52/11 |
| 5,651,466 | A * | 7/1997 | Satomi | 209/734 |
| 5,913,334 | A * | 6/1999 | Hyun | 137/810 |
| 6,082,925 | A * | 7/2000 | Raasch | 404/2 |
| 6,305,410 | B1 * | 10/2001 | Cook et al. | 137/363 |
| 6,374,858 | B1 * | 4/2002 | Hides et al. | 137/813 |
| 6,406,216 | B1 * | 6/2002 | Raasch | 404/2 |
| 7,261,008 | B2 * | 8/2007 | Saaski et al. | 73/863.22 |

FOREIGN PATENT DOCUMENTS

| | | | |
|---|---|---|---|
| GB | 2267976 | A | 12/1993 |
| GB | 2 409 537 | A | 6/2005 |
| WO | WO-8908750 | A1 | 9/1989 |
| WO | WO-9204667 | A1 | 3/1992 |
| WO | WO-2008 064683 | A1 | 6/2008 |

OTHER PUBLICATIONS

Int'l Preliminary Report on Patentability for Application PCT/GB2008/002548 dated Feb. 4, 2010.

EP Search Report for Application EP10188612 dated Apr. 5, 2011.

International Search Report for Application PCT/DK2008/050104 dated Sep. 22, 2008.

International Search Report for PCT/GB2008/002548, dated Apr. 5, 2011.

* cited by examiner

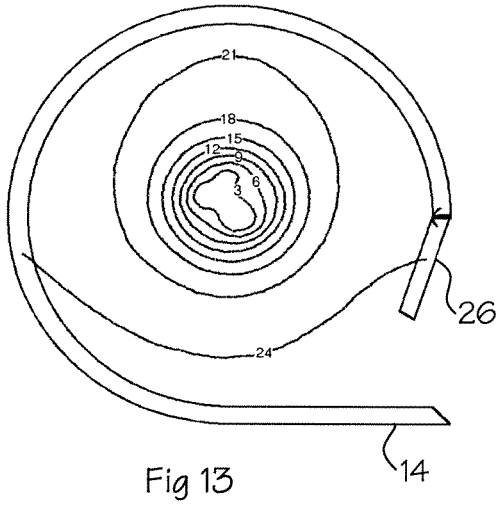
Fig 13
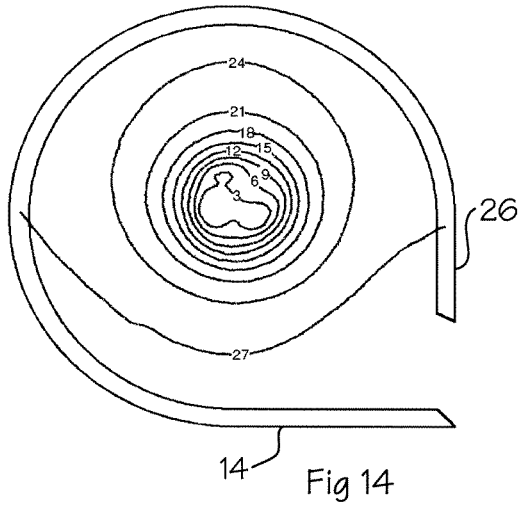
Fig 14
Fig 15
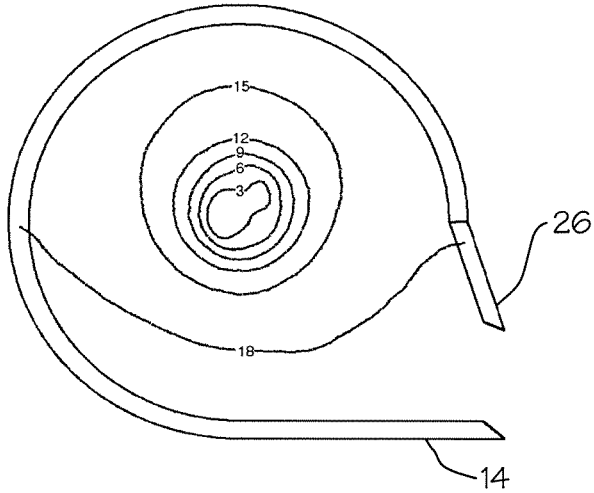
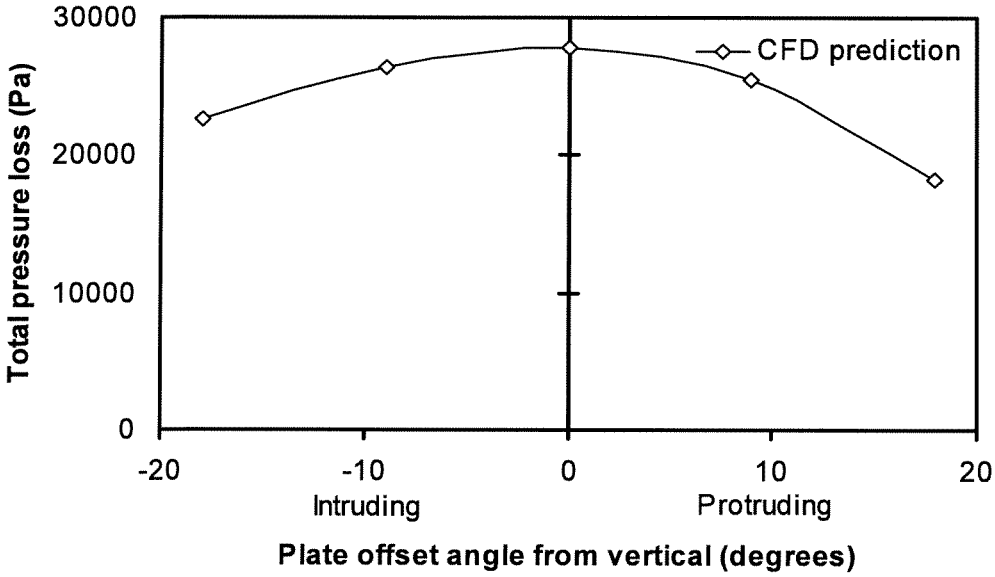
Fig 16

VORTEX FLOW CONTROL DEVICE

BACKGROUND OF THE INVENTION

This invention relates to a vortex flow control device.

Vortex flow control devices, or "vortex valves", are used, for example, in storm water systems to restrict the flow rate of storm water to a main sewer under heavy flow conditions. For example, a gully receiving storm water from kerbside gratings may be provided with a vortex flow control device at its outlet so that, under storm conditions, the outflow from the gully is restricted. If the inflow to the gully exceeds the outflow as controlled by the flow control device, water accumulates in the gully until conditions ease.

Such a device is disclosed in GB 2409537. The device comprises a housing having oppositely disposed end walls and an outer wall which extends about an axis and is disposed between the end walls. One of the end walls has an outlet positioned generally on the axis, and the housing also has an inlet directed tangentially of the axis so that, when the pressure head above the device exceeds a certain value, the inflowing water generates a vortex within the housing so restricting outflow through the outlet.

In the device of GB 2409537, the inlet is constituted by a circumferential gap in the outer wall, the size of which can be varied by means of a sliding arcuate plate. Thus, the same housing can be used to provide a vortex flow control device having different characteristics, achieved by appropriate positioning of the arcuate plate. Also, a vortex flow control device that has already been installed can have its characteristics altered, for example if there is a change in the flow regime in which it operates, by adjusting the arcuate plate.

Another such device, referred to as a vortex throttle, is disclosed in U.S. Pat. No. 5,524,393. The device described is for controlling water run-off from roofs.

According to one aspect of the present invention, there is provided a vortex flow control device comprising a housing defining a vortex chamber, the housing comprising oppositely disposed end walls and an outer wall extending about an axis and disposed between the end walls, the outer wall comprising a curved portion which extends around the axis, one end of the curved portion adjoining a planar portion which extends in a tangential direction with respect to the axis to a first free edge, and the other end of the curved portion adjoining a terminal portion which extends in a direction towards the planar portion and terminates at a second free edge, an outlet from the housing being disposed in one of the end walls, and an inlet to the housing being defined in the outer wall between the second free edge and the planar portion, the inlet being configured so that fluid entering the vortex chamber through the inlet induces a circulating flow within the vortex chamber about the axis, characterised in that the terminal portion is directed away from the circulating flow in the direction towards the upstream edge, whereby turbulence is induced in the region of the inlet by fluid entering the vortex chamber through the inlet, the terminal portion being inclined to the planar portion at an angle not less than 85° and not more than 95°.

In an embodiment of such a device, the outer wall may be fabricated from first and second outer wall components, the first outer wall component comprising the planar portion and the curved portion, and the second outer wall component comprising the terminal portion which is secured to the end walls and to the curved portion.

The terminal portion may be oriented so that it is directed from the curved portion towards the free edge of the planar portion. The inlet may lie in a plane which is perpendicular to the tangential direction of the planar portion.

The curved portion of the outer wall may extend around the axis over an angle of not less than 270°. In a specific embodiment, the planar portion and the terminal portion are substantially perpendicular to each other.

According to another aspect of the present invention, there is provided a method of manufacturing a vortex flow control device comprising a housing defining a vortex chamber, the housing comprising oppositely disposed end walls and an outer wall extending about an axis and disposed between the end walls, an outlet from the housing being disposed in one of the end walls, and an inlet to the housing being disposed in the outer wall and configured so that fluid entering the vortex chamber through the inlet induces a circulating flow within the vortex chamber about the axis, the inlet being defined between an upstream edge and a downstream edge of the outer wall with respect to the direction of the circulating flow in the region of the inlet, the upstream edge being an edge of a terminal portion of the outer wall, characterised in that the method comprises the steps of:

(a) manufacturing a template unit comprising the end walls and a partial outer wall excluding the terminal portion; and (b) subsequently securing the terminal portion of the outer wall to the template unit.

The length of the terminal portion, between the second transition and the downstream edge, may be determined on the basis of the required characteristics of the vortex flow control device.

According to a third aspect of the present invention, there is provided a method of manufacturing a vortex flow control device comprising a housing defining a vortex chamber, the housing comprising oppositely disposed end walls and an outer wall extending about an axis and disposed between the end walls, an outlet from the housing being disposed in one of the end walls, and an inlet to the housing being disposed in the outer wall and configured so that fluid entering the vortex chamber through the inlet induces a circulating flow within the vortex chamber about the axis, the inlet being defined between an upstream edge and a downstream edge of the outer wall with respect to the direction of the circulating flow in the region of the inlet, the upstream edge being an edge of a terminal portion of the outer wall, characterised in that the method comprises the steps of:

(a) manufacturing a plurality of identical template units, each comprising the end walls and a partial outer wall excluding the terminal portion;

(b) determining desired characteristics of a vortex flow control device to be supplied;

(c) determining the required dimensions of a terminal portion to be secured to one of the template units to provide the desired characteristics; and (d) securing a terminal portion of the required dimensions to the said one template unit.

The second planar portion may be secured to the template unit by welding.

In an alternative embodiment of the vortex flow control device, the housing may comprise a one-piece molding.

According to a fourth aspect of the present invention, there is provided a method of manufacturing a vortex flow control device comprising a housing which is a one-piece molding defining a vortex chamber, the housing comprising oppositely disposed end walls and an outer wall extending about an axis and disposed between the end walls, an outlet from the housing being disposed in one of the end walls, and an inlet to the housing being disposed in the outer wall and configured so that fluid entering the vortex chamber through the inlet induces a circulating flow within the vortex chamber about the axis, the inlet being defined between an upstream edge and a downstream edge of the outer wall with respect to the direction of the circulating flow in the region of the inlet, the upstream edge being an edge of a terminal portion of the outer wall, characterised in that the method comprises the steps of:

(a) manufacturing a template unit comprising the end walls and the outer wall;

(b) removing a region of the outer wall to form the free edges of the terminal portion and the planar portion, thereby forming the inlet with a desired dimension.

For a better understanding of the present invention, and to show more clearly how it may be carried into effect, reference will now be made, by way of example, to the accompanying drawings, in which:—

BRIEF DESCRIPTION OF THE DRAWINGS

FIG. 13 represents the pressure gradient in a vortex flow control device not in accordance with the present invention;

FIG. 14 corresponds to FIG. 13 but represents a vortex flow control device in accordance with the present invention;

FIG. 15 represents the pressure gradient in another vortex flow control device not in accordance with the present invention; and FIG. 16 is a graph displaying the overall pressure drop in vortex flow control devices of different geometry.

DETAILED DESCRIPTION OF THE INVENTION

Figure 1:
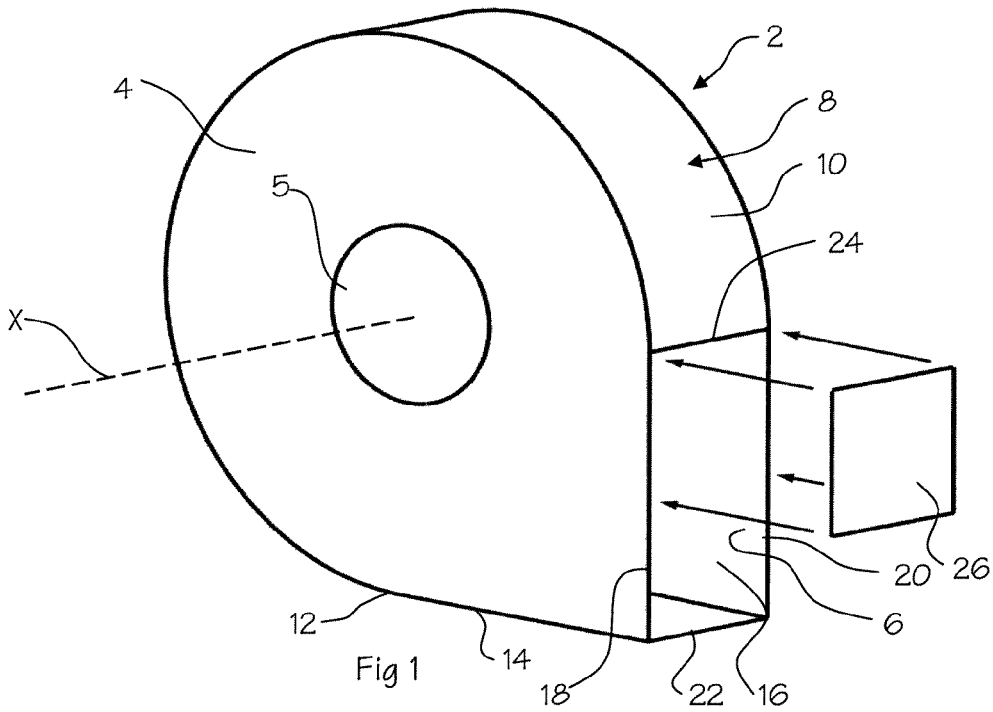
FIG. 1 shows a template unit receiving an outer wall component to form a vortex flow control device.
Figure 2:
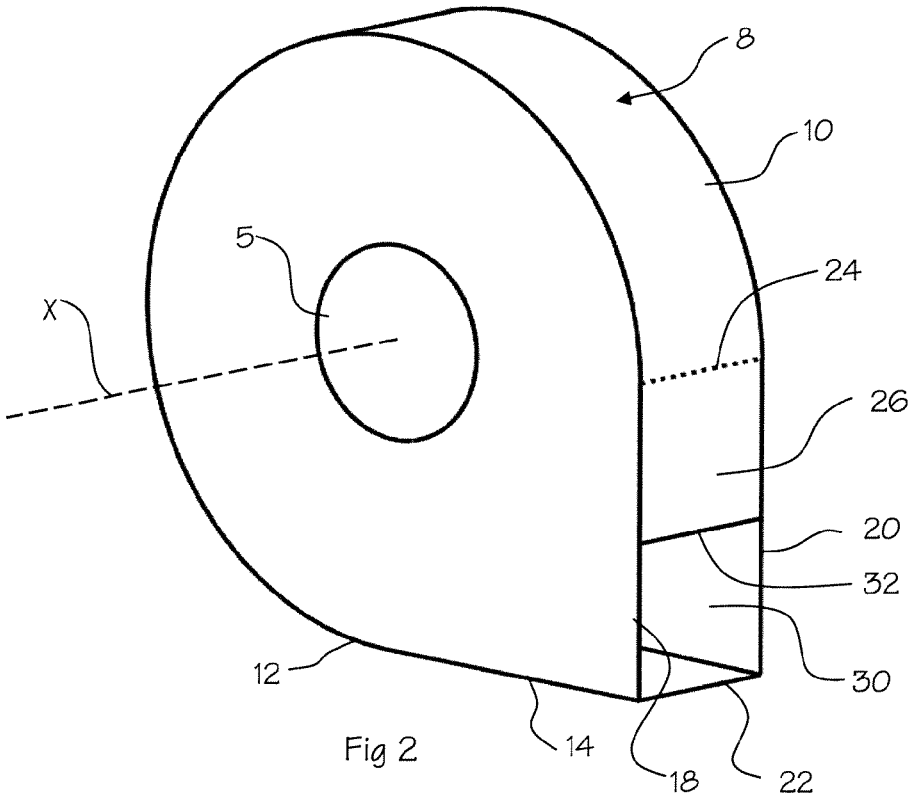
FIG. 2 shows the finished vortex flow control device.

Referring to FIG. 1, a template unit 2 is shown as comprising parallel end walls 4, 6 and a first outer wall component 8. The outer wall component 8 comprises a curved portion 10 which merges smoothly at a transition 12 into a planar portion 14. The curved portion 10 extends circumferentially about an axis X. An outlet 5 is provided in the end wall 4, and is situated on the axis X. The curved portion 10 may be truly cylindrical, i.e. circular as viewed along the axis X, but in alternative embodiments it may have a non-circular configuration, for example in the form of a spiral. As shown in FIGS. 1 and 2, the outer wall component 8 has a single curvature, about the axis X. The curved portion 10 and the planar portion 14 may be formed from a single appropriately shaped length of sheet material, such as steel. Similarly, the end walls 4, 6 may be made from steel sheet.

The template unit 2 has an opening 16. The opening 16 is defined by parallel straight edges 18, 20 of the end walls 4, 6, by a first free edge 22 of the planar portion 14, and by a second edge 24 of the curved portion 10. The opening 16 is thus rectangular and lies in a single plane.

A terminal portion in the form of a flat plate 26, constituting a second outer wall component, can be fitted to the template unit 2 so that the opening 16 is partially closed. Thus, the plate 26, which is rectangular, is welded to the template unit at the edges 18, 20 of the end walls 4, 6, and at the edge 24 of the curved portion 10.

The resulting completed unit is shown in FIG. 2. It will be appreciated that the plate 26 adjoins the curved portion 10 at the edge 24, which thus constitutes a second transition, corresponding to the first transition 12, in the outer wall made up of the first and second outer wall components 8, 26. The plate 26 terminates opposite the transition 24 at a second free edge 32, which, with the first free edge 22, defines the upper and lower extremities of an inlet 30 of the completed device.

Since the edges 18, 20 of the end walls 4, 6 adjoin lateral edges of the plate 26 and extend to the first free edge 22, it will be appreciated that the orientation of the plate 26 is such that it is directed from the transition 24 towards the first free edge 22. Furthermore, the planar portion 14 is perpendicular to the edges 18, 20 of the end walls 4, 6 and consequently perpendicular also to the plate 26.

In an alternative embodiment, the template unit may be made as a one-piece molding, with the opening 16 entirely closed in the as-molded form so that the outer wall is circumferentially continuous around the template unit. Thus, instead of adding the flat plate 26 to reduce the size of the opening 16 to the desired size of the inlet 30, the inlet 30 is cut to the required size in a flat region of the outer wall 8 corresponding to the opening 16 in FIG. 1.

For use, the device shown in FIG. 2 may be installed in a gully into which stormwater is discharged during periods of rainfall. The device is mounted in the gully so that the inlet 30 is exposed to the interior of the gully, and the outlet 5 is connected to an outlet pipe extending from the gully to a sewer or other duct receiving flow from the gully.

At low rates of flow into the gully, water entering the device through the inlet 30 can flow to the outlet 5 when the level in the gully reaches the lowermost part of the outlet 5. At higher flow rates, the level in the gully will rise further, and the increased pressure head will increase the flow rate of water through the inlet 30. Because the flow through the inlet 30 is directed tangentially of the axis X, the incoming flow will induce a vortex within the device about the axis X. Under these circumstances, the edge 22 can be regarded as an upstream edge with respect to the circumferential direction of flow in the vortex, and the edge 32 can likewise be regarded as a downstream edge.

Figure 3:
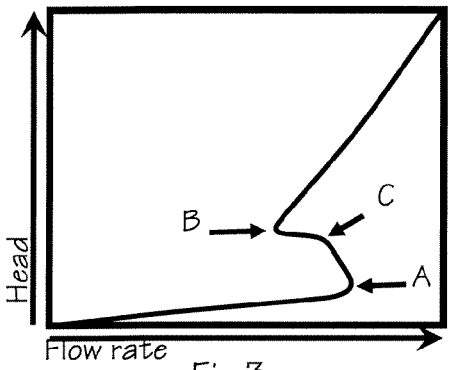
FIG. 3 is a flow characteristic of a vortex flow control device in accordance with FIG. 2.

It has been found surprisingly that a vortex flow control device having the configuration shown in FIG. 2 results in a flow characteristic, as shown in FIG. 3, which has surprising advantages.

Figure 4:
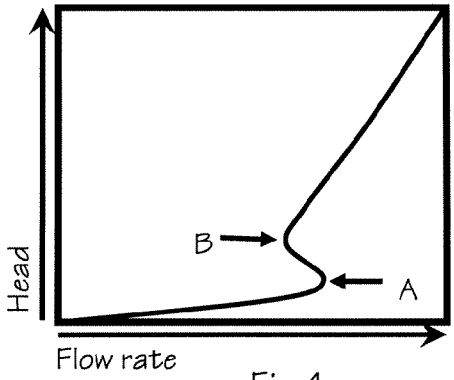
FIG. 4 is a flow characteristic of a known vortex flow control device.

Considering first the flow characteristic shown in FIG. 4, of a known vortex flow control device, it will be seen that, as the pressure head to which the device is subjected is increased, the flow rate through the device initially increases relatively quickly to a reversal point A. This is the point at which the vortex is initiated within the device. The flow rate thus decreases with increasing pressure head, as the vortex becomes established, until a second reversal point B is reached, at which the vortex is fully developed. As the pressure head increases from the point B, the flow rate increases again, but at a lower rate of increase than occurs up to the point A.

It will be appreciated that the flow characteristic shown in FIG. 3, for a device as shown in FIG. 2, has an additional transition point C following the reversal point A. Thus, as the pressure head increases from the point A, the reduction in flow rate is initially less rapid than is shown in FIG. 4, but continues over a relatively large pressure head increase. At point C, as the vortex becomes fully developed, the reduction in flow rate is relatively rapid to the point B, after which the flow rate increases as in the characteristic of FIG. 4. It will be appreciated that the reduction in flow rate from point A to point B is greater in the device in accordance with the present invention (FIG. 3) than in the known device (FIG. 4).

An ideal characteristic for a vortex flow control device would be one in which the flow increases gradually with increasing pressure head up to the point A, and which then remains constant, i.e. is represented as a vertical line on the characteristic with any further increases in pressure head. It will be appreciated from FIGS. 3 and 4 that a device in accordance with the present invention, as shown in FIG. 2, permits a flow rate which remains at or below that at point A for a greater increase in pressure head than in the known device.

Figure 5:
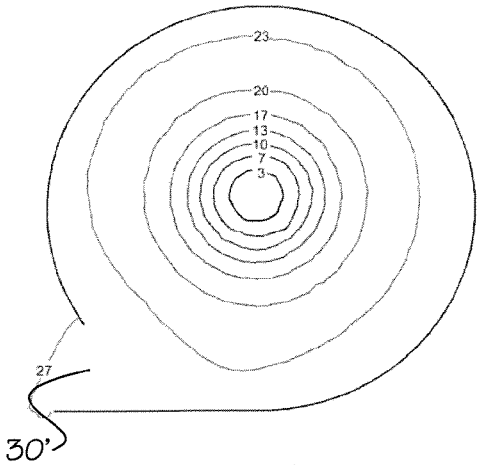
FIG. 5 represents the pressure gradient in a known vortex flow control device.
Figure 6:
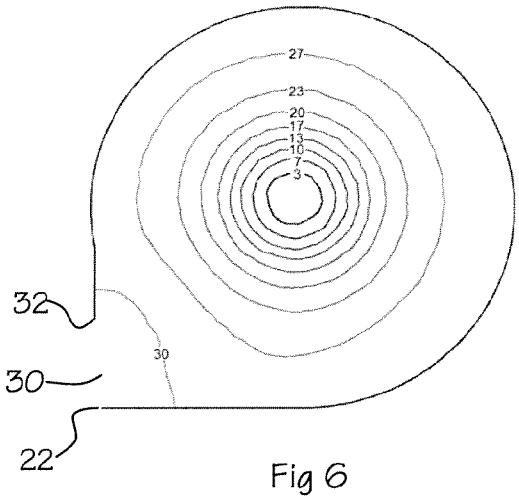
FIG. 6 represents the pressure gradient in a flow control device in accordance with FIG. 2.

FIGS. 5 and 6 again compare a known device (FIG. 5) with a device as shown in FIG. 2 (FIG. 6). FIGS. 5 and 6 represent contours of static pressure, measured in kilopascals (kPa) relative to the pressure at the outlet 5 (not shown in FIGS. 5 and 6). FIGS. 5 and 6 represent vortex flow control devices with the same outer dimension and the same diameter of the outlet 5. It will be appreciated that a device in accordance with the present invention (FIG. 6) supports a higher pressure difference between the inlet 30 and the outlet 5 than a known similar device (FIG. 5—in which the inlet is designated as 30'). In particular, it will be appreciated that the pressure difference exceeds 30 kPa in a device in accordance with the present invention and is only approximately 24 kPa in the known device.

The consequence of this is that to achieve the same pressure difference, a vortex flow control device in accordance with the present invention can have a larger-diameter outlet 5. This has advantages in that the outlet 5 will be less prone to blockage.

Figure 7:
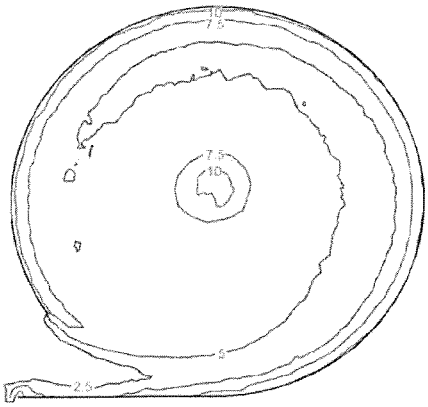
FIG. 7 represents turbulence intensity in a known vortex flow control device.
Figure 8:
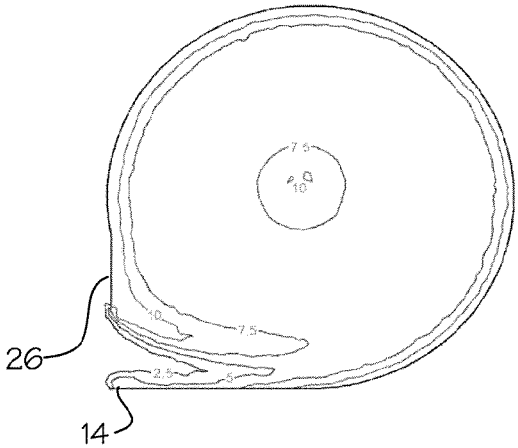
FIG. 8 represents turbulence intensity in a vortex flow control device in accordance with FIG. 2.
Figure 9:
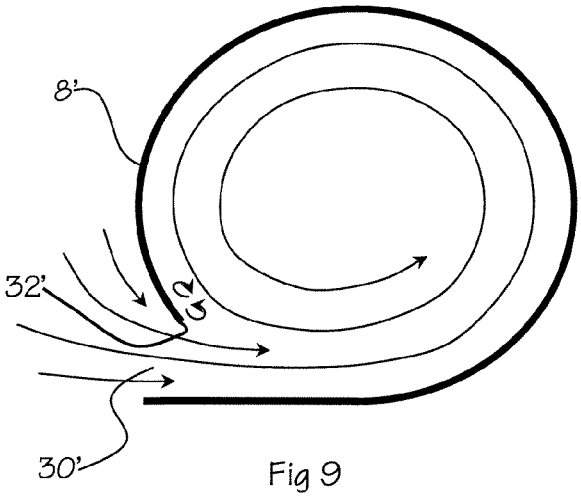
FIG. 9 represents the flow pattern in the vortex flow control device of FIG. 5.
Figure 10:
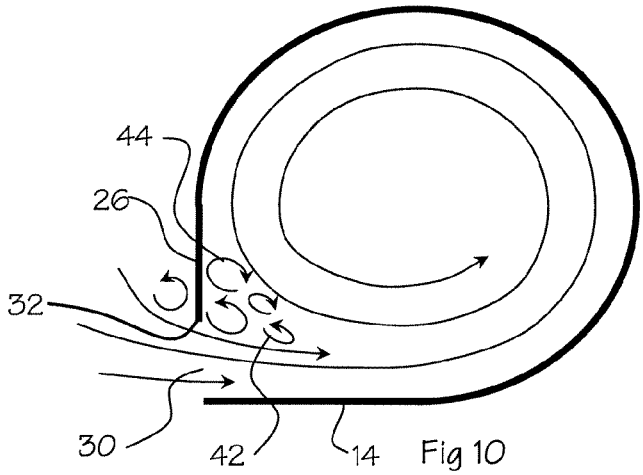
FIG. 10 corresponds to FIG. 9 but shows a vortex flow control device as shown in FIG. 2.

FIGS. 7 to 11 indicate how the increased pressure loss is achieved. Because the outer wall 8' of a conventional unit (FIGS. 7 and 9) is curved up to the free edge 32' at the inlet 30', the flow path is relatively streamlined, both as flow enters the unit through the inlet 30', and also as it spins around inside. Consequently, there is a smooth transition from the flow outside the device to the circumferential vortex flow within the device. The turbulence intensity, as represented in FIG. 7, is relatively low at the inlet 30'. It has previously been believed that the minimising of turbulence in this region was beneficial in achieving a desired predictable flow characteristic over the operating range of the device. In an embodiment in accordance with the present invention, as shown in FIGS. 8 and 10, the flat plate 26, perpendicular to the oppositely disposed planar portion 14, causes the flow path to be less streamlined. This has the effect of encouraging 'flow separation' from the outer wall 8 as the flow enters the unit, and also as the flow circulates within the unit. It also creates turbulence outside the unit. These separation regions typically comprise small flow recirculations or eddies 42, 44. As shown in FIG. 10, the eddies 42 generated by the inflow and eddies 44 generated by the circulating flow are in opposite directions. It is believed that this contra rotation creates the increased turbulence as a result of flow shearing between the eddies 42 and 44.

The turbulence intensity referred to above, which is expressed as a percentage in FIGS. 7 and 8, is the ratio of the root-mean-square of the turbulent velocity fluctuations to the mean velocity of the flow.

From the above, it will be appreciated that the configuration of the outer wall 8 in a vortex flow control device in accordance with the present invention provides enhanced performance of the device, both in terms of the flow characteristic as shown in FIG. 3, and in terms of the pressure loss which is achieved in operation. Furthermore, a vortex flow control device in accordance with the present invention has advantages in the manufacture of the device.

As shown in FIG. 1, the plate 26 is secured to the template unit 2 (for example by welding at the edges 18, 20 and 24) as the final step in the manufacturing process, or one of the final steps. The length of the plate 26 from the transition 24 to the downstream edge 32 determines the size of the inlet 30 and consequently determines the flow characteristics of the finished device. Consequently, it is possible to construct a plurality of different devices, having different flow characteristics, from identical templates 2, simply by attaching an appropriately sized plate 26. A batch of identical template units 2 can be manufactured efficiently, and held in stock. When there is a requirement for a vortex flow control device having a specified flow characteristic, the device can be constructed from one of the stocked template units by attaching an appropriately sized plate 26. The plates 26 can be manufactured specifically for each order, or a stock of differently sized plates 26 can be maintained, to be drawn off as required.

A single size of template unit 2 can thus cover a large range of flow conditions. To extend the range of flow conditions which can be covered, the template units 2 may be constructed in different sizes, but the specified flow characteristic can still be achieved at the final manufacturing stage by fitting an appropriately sized plate 26.

Figure 11:
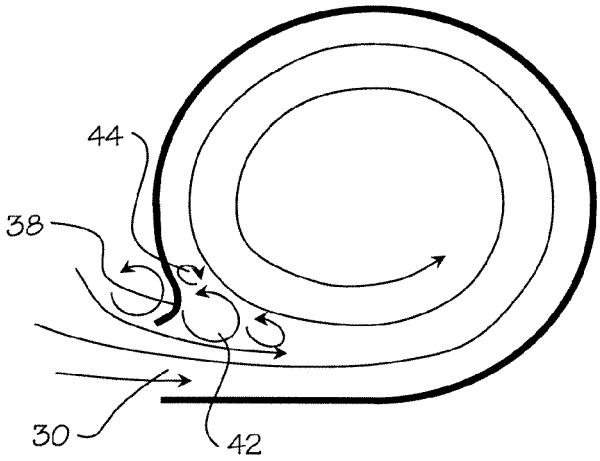
FIG. 11 corresponds to FIG. 10 but shows an alternative flow control device.
Figure 12:
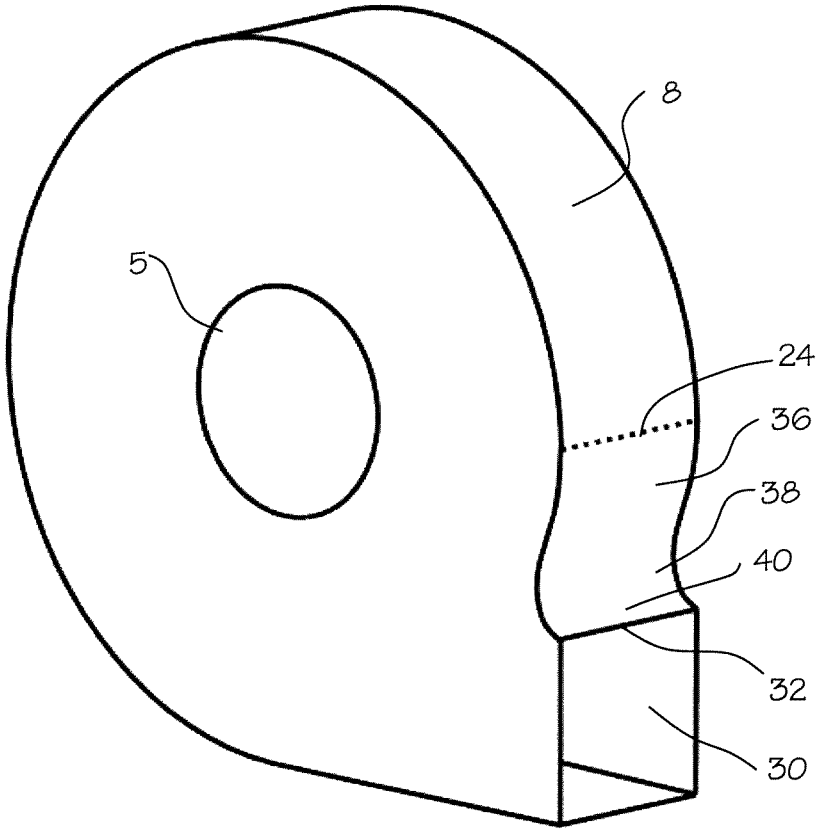
FIG. 12 is a view of the vortex flow control device of FIG. 11.

FIGS. 11 and 12 show an alternative embodiment of a vortex flow control device. Parts which are similar to those shown in FIG. 2 are represented by the same reference numbers. In the embodiment of FIGS. 11 and 12, the terminal portion extending to the downstream edge 32 is not in the form of a separate plate 26 as in the embodiment of FIGS. 1 and 2, but is instead a continuation 36 of the curved portion 10. Although not constituted by a physical joint, the notional second transition 24 is represented in FIG. 12.

The terminal portion 36 includes a reverse curve 38, so that the region 40 nearest the downstream edge 32 is directed away from the interior of the device, in other words outwardly of the vortex chamber defined within the housing 2, so increasing the flow separation, and consequently the turbulence intensity, as the flow passes through the inlet 30 and circulates within the unit.

The device as shown in FIGS. 11 and 12 may be formed as a template comprising a one-piece molding, for example by rotational molding, but with the material of the molding extended beyond the inlet 30 as shown in FIG. 9. The final position of the opening 30 is then determined in accordance with the required flow characteristics of the device, and superfluous material is then severed from the original template to form the opening 30 of the required size. As a result of the molding process, the outer wall 8 may be circumferentially continuous, so that the inlet 30 is completely closed until part of the outer wall 8 is cut away.

FIG. 11 shows the effect of the reverse curve 38 as giving a sharper inlet, thereby encouraging more separation both inside and more circulation outside the unit, and hence more turbulence and energy loss.

It will be appreciated that the manufacturing process described with reference to FIGS. 1 and 2 could also be applied to a vortex valve having the configuration shown in FIG. 12, and vice versa.

FIGS. 13 to 16 demonstrate the effect of the angle between the plate 26 and the planar portion 14. In FIGS. 13 and 15, the plate 26 is inclined at 18° to the planar portion 14, either intruding into the vortex chamber (FIG. 13) or protruding from it (FIG. 15). In the variant of FIG. 14, in accordance with the present invention, the plate 26 is perpendicular to the planar portion 14.

All of the variants of FIGS. 13 to 15 have outlets 5 (not shown) having a diameter of 100 mm and were evaluated by Computational Fluid Dynamics modelling (CFD) under the same conditions. It will be appreciated from the pressure contours shown in FIGS. 13 to 15 that the unit shown in FIG. 14 supported the greatest pressure drop. This is confirmed by the table below, which includes results not only from the variants shown in FIGS. 13 to 15, but also two further variants in which the plate 26 is inclined in opposite directions by 9°.

| Inlet Angle | −18 | −9 | 0 | 9 | 18 |
|---|---|---|---|---|---|
| Pressure Loss | 22602 | 26331 | 27754 | 25461 | 18282 |

It will be appreciated from these results that the maximum pressure drop supported by the unit occurs when the plate 26 is at or close to perpendicular to the planar portion 14, and consequently that the variant of FIG. 14 provides superior results if the objective is to maximise the diameter of the outlet 5 for any given pressure load.

The invention claimed is:

1. A vortex flow control device comprising a housing defining a vortex chamber, the housing comprising:

oppositely disposed end walls, each end wall having at least one free edge;

an outer wall extending about an axis and disposed between the end walls, the outer wall comprising a curved portion which extends around the axis, one end of the curved portion adjoining a planar portion which extends in a tangential direction with respect to the axis to a first free edge, and the other end of the curved portion adjoining a terminal portion which extends in a direction towards the planar portion and terminates at a second free edge;

an outlet from the housing disposed in one of the end walls; and a rectangular inlet to the housing defined in the outer wall by the free edges of the end walls and by the second free edge and the first free edge, the inlet being configured so that fluid entering the vortex chamber through the inlet induces a circulating flow within the vortex chamber about the axis, wherein the terminal portion is directed away from the circulating flow in the direction towards the first free edge, whereby turbulence is induced in the region of the inlet by fluid entering the vortex chamber through the inlet, wherein the terminal portion is selectively arrangeable with respect to the planar portion at an orientation of at least three orientations, being:

a first inclined orientation, wherein the first inclined orientation results in the terminal portion intruding into the vortex chamber, a second inclined orientation, wherein the second inclined orientation results in the terminal portion protruding away from the vortex chamber, and a neutral orientation between the first inclined orientation and the second inclined orientation, wherein the neutral orientation results in the terminal portion being arranged perpendicularly with respect to the planar portion and does not intrude into the vortex chamber or protrude away from the vortex chamber, wherein the orientation of the terminal portion with respect to the planar portion is defined by an angle not less than 85° when the terminal portion is arranged in the first inclined orientation and not more than 95° when arranged in the second including orientation.

2. A vortex flow control device as claimed in claim 1, wherein the terminal portion is flat and extends tangentially with respect to the axis.

3. A vortex flow control device as claimed in claim 2, wherein the terminal portion is directed from the curved portion towards the first free edge.

4. A vortex flow control device as claimed in claim 1, wherein the terminal portion, as viewed parallel to the axis, includes a reverse curve whereby a region of the terminal portion adjacent the second free edge is directed outwardly of the vortex chamber.

5. A vortex flow control device as claimed in claim 1, wherein the inlet lies in a plane perpendicular to the tangential direction of the planar portion.

6. A vortex flow control device as claimed in claim 1, wherein the curved portion extends between the planar portion and the terminal portion over an angle of not less than 270° about the axis.

7. A vortex flow control device as claimed in claim 1, wherein the outer wall is constructed from a first component comprising the planar portion and the curved portion, and a second component comprising the terminal portion.

8. A vortex flow control device as claimed in claim 1, wherein the housing comprises a one-piece molding.

* * * * *

UNITED STATES PATENT AND TRADEMARK OFFICE

CERTIFICATE OF CORRECTION

PATENT NO. : 8,555,924 B2
APPLICATION NO. : 12/670628
DATED : October 15, 2013
INVENTOR(S) : Michael G. Faram et al.

It is certified that error appears in the above-identified patent and that said Letters Patent is hereby corrected as shown below:

Title Page: Item 57

Line 8 of the Abstract, please delete "his" and insert --is--.

Signed and Sealed this
Seventh Day of January, 2014

Margaret A. Focarino

Margaret A. Focarino
*Commissioner for Patents of the United States Patent and Trademark Office*